US007062791B2

(12) United States Patent
Gold

(10) Patent No.: US 7,062,791 B2
(45) Date of Patent: Jun. 20, 2006

(54) PRE-CURVED GUNN CUT GLOVES

(76) Inventor: Danny Gold, 14 Tregunter Path, Tregunter Tower 2, Apartment 33B, Hong Kong (HK)

( * ) Notice: Subject to any disclaimer, the term of this patent is extended or adjusted under 35 U.S.C. 154(b) by 0 days.

(21) Appl. No.: 10/357,291

(22) Filed: Feb. 3, 2003

(65) Prior Publication Data

US 2003/0208833 A1 Nov. 13, 2003

Related U.S. Application Data

(60) Provisional application No. 60/353,426, filed on Feb. 1, 2002.

(51) Int. Cl.
*A41D 19/00* (2006.01)

(52) U.S. Cl. ..... 2/161.6; 2/163; 2/169

(58) Field of Classification Search ..... 2/161.6, 2/169, 163

See application file for complete search history.

(56) References Cited

U.S. PATENT DOCUMENTS 2,041,201 A * 5/1936 Neback ..... 2/20
4,779,289 A * 10/1988 Prouty ..... 2/16
5,697,104 A * 12/1997 Welton ..... 2/161.1
5,857,216 A * 1/1999 Gold ..... 2/169
5,924,137 A * 7/1999 Gold ..... 2/161.1
6,279,166 B1 * 8/2001 Schild ..... 2/163
6,460,192 B1 * 10/2002 Kindler ..... 2/167
6,654,964 B1 * 12/2003 Staihar et al. ..... 2/161.1
6,732,378 B1 * 5/2004 Novak ..... 2/161.6

* cited by examiner

*Primary Examiner*—Katherine M. Moran
(74) *Attorney, Agent, or Firm*—Aufrichtig Stein & Aufrichtig P.C.; Peter D. Aufrichtig

(57) ABSTRACT

A gunn cut glove construction in which a pre-curvature at selected locations, preferably around the joints, in the fingers is achieved by sewing wedges of material into cut portions of the gunn section so that the shortened fingers and larger back sections easily meet at and can be joined without the need to gather or moccasin material resulting in the shape of the finger being such that it curves forward towards the palm section. Increased volume at the fingertips of a gunn cut construction glove is achieved by darting the palm side pieces of fingers proximate the fingertips. In addition, to reduce the inflexibility of gloves when curled into a fist, an elliptical piece is removed from the palm portion of the glove and the sides of the elliptical piece are sewn together along a seam.

17 Claims, 7 Drawing Sheets

PRE-CURVED GUNN CUT GLOVES

This applications claims the priority of provisional application No. 60/353,426 filed Feb. 1, 2002.

BACKGROUND OF THE INVENTION

The invention is generally directed to pre-curved gloves designed to fit the normal curvature of the hand at rest or the curved formation of the hand in certain sporting activities, and in particular, to pre-curved glove patterns utilizing a gunn cut construction with enhanced fit in the palm region and fingers.

The public has come to see an increasing need for pre-shaped glove patterns which enhance the feel of the glove. Generally, the hand at rest is not in a position in which the fingers are straight, extending outwardly from the palm. Rather, the most comfortable at rest position is one in which the fingers are gently curved inwardly toward the palm. Accordingly, there is a need for gloves which are to be worn in a variety of activities, and, in particular, for skiing, snowboarding and other outdoor activities where warmth is required, to keep the fingers of the hand in a natural position. There is a similar need in sailing, golf, racquetball, squash, driving and industrial gloves. In the event that a glove is designed with straight fingers, there will be a stress between the fingers and the glove as the fingers try to maintain their comfortable, at rest curved position against the straight fingers of the glove.

Traditionally, the method used for pre-shaping of gloves is to make the back of the glove longer than the palm and introduce pre-shaped fourchettes and side walls to balance the sewing of the glove. In a traditional glove the glove includes a palm portion which includes the palm side of the fingers; a back portion which generally also includes the back portion of the fingers; fourchettes which provide the panels between the palm and back portions in the finger region; and side walls, on the outside of the hand and index finger.

In my earlier U.S. Pat. No. 5,857,216, the pre-shaping of the gloves to introduce the curvature is accomplished by cutting a straight fourchette, rather than the more traditionally curved fourchettes, and darting sections thereof to control the pre-shaping at more specific points. The darting reduces the length of the fourchette along the palm side of the glove, thereby allowing it to fit to the shortened palm fingers. However, when it comes to gunn cut patterns, there is no fourchette. So the pre-shaping is very hard to control in making the finger (gunn sections) shorter than the back. Also, there tends to be too much material on the palm portion of a gunn cut glove, which makes curling the fingers inward to make a fist difficult due to the excess material there. Accordingly, there is a need to remove material. In addition, even if material is removed, there tends to be a difficulty in making a fist and an improvement in this area which enhances the ability of a gunn cut construction glove includes a reduced area of the palm which is windowed with a guard or patch. In this way the bending in the area of the palm where the hand actually bends is enhanced. There is also a need to enhance the volume of the fingers in a gunn cut construction.

SUMMARY OF THE INVENTION

The invention is generally directed to a gunn cut glove construction in which a pre-curvature at selected locations in the fingers is achieved by sewing wedges of material into cut portions of the gunn section so that the shortened fingers and larger back sections easily meet at and can be joined without the need to gather or moccasin material resulting in the shape of the finger being such that it curves forward towards the palm section.

Accordingly, it is an object of the invention to provide an improved pre-curved glove utilizing a gunn cut construction.

Another object of the invention is to provide an improved gunn cut glove construction which uses pre-curvature without the need for gathering or moccasining of the connection between the back portion of the fingers and the gunn section or sections.

Still another object of the invention is to provide an improved pre-curved gunn cut construction in which the pre-curvature is achieved by lengthening the edge of the gunn section which mates with the back of the fingers so that a straight connection without gathering is achieved but which includes the shortened palm section which creates a pre-curvature to the fingers.

Yet still a further object of the invention is to provide an improved pre-curved glove utilizing a gunn cut construction in which the pre-curvature provides a clean, non-gathered seam between the back section of the glove and the palm portion of the gunn sections and the palm sections of the fingers are longitudinally stabilized by a stiffening member.

Still a further object of the invention is to provide an improved glove utilizing a gunn cut construction which has an elliptical section removed and the sides of the elliptical opening sewn together and an area of the palm portion around the sewn seam is windowed with a patch having an opening over the sewn seam.

Yet another object of the invention is to provide an improved pre-curved gunn cut glove or mitten construction in which additional volume to the fingers is provided by darting the fingertip areas of the gunn cut sections.

A further object of the invention is to provide an improved pre-curved gunn cut construction in which the palm is cut with an elliptical shape taken out and then stitched together and a patch around the cutout is added with an opening over the stitched seam.

Yet still a further object of the invention is to improve the wearability of gunn cut construction by reducing wear on the finger tip seam and increase sensitivity at the fingertips by wrapping the palm portion of the fingers over to the back a distance and joining the back and front portions away from the fingertips.

Still other objects and advantages of the invention will, in part, be obvious and will, in part, be apparent from the specification.

The invention accordingly comprises the features of construction, combination of elements, arrangement of parts, combinations of steps and procedures, all of which will be exemplified in the constructions and processes hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 4:
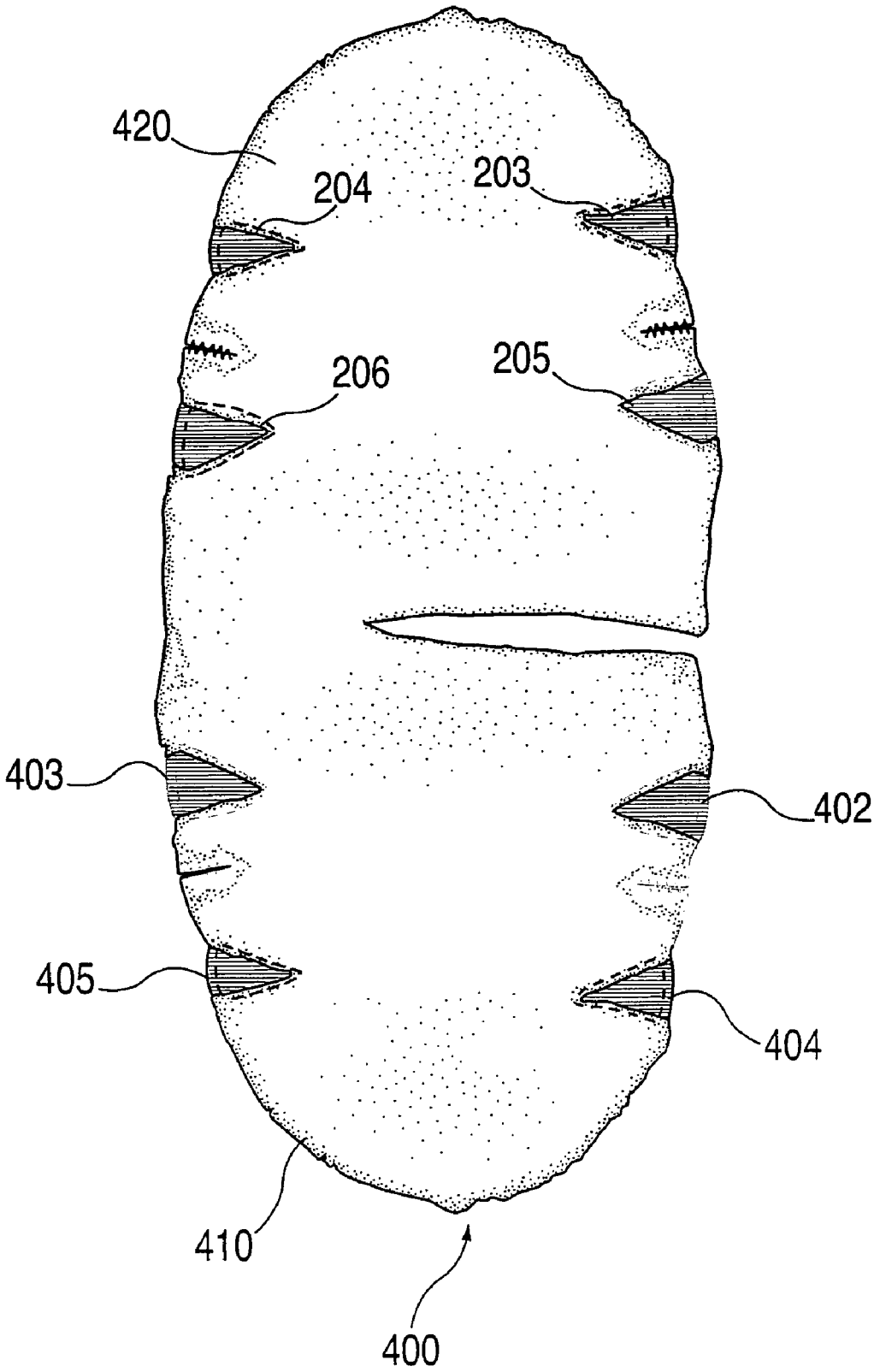
FIG. 4 is a top plan view of a gunn section of the palm portion of the fingers for a glove constructed in accordance with a preferred embodiment of the invention.

In a gunn cut construction the finger portions of the glove are sewn to the remaining portion of the glove at a point just below the joints of the four fingers. The front and back upper portions of the hand of a gunn cut glove (which cover the body of the hand), are conventionally formed as separate pieces joined together. The back sections of the fingers are formed as a single piece sewn to the upper portion of the glove, which covers the body of the hand. The palm side of the fingers are formed with one or more gunn cut sections 400 as shown in FIG. 4. The gunn cut section 400 of FIG. 4 is used to form the palm and part of the sides of two separate fingers. As can be most clearly seen in FIG. 4, the exterior perimeter of the palm finger sections 410, 420 are cut and then spread with another material shown in FIG. 4 as the darker material in the triangular regions. The cut portions 402, 403, 404 and 405 are simple slits which are spread and then sewn around the perimeter of the slits to the underlying material 201 (Shown in FIG. 5). As shown in the upper portion of FIG. 4, the triangular materials which spread the slits correspond to wings 203, 204, 205 and 206 in backing material 201 shown in FIG. 5. A separate backing material section 201 would be used for each of the finger regions. Thus, the gunn cut section 400 shown in FIG. 4 would have two separate backing sections, one for each finger. These outside perimeters are the portion of the gunn cut sections which are sewn to the finger backs to form the fingers. The rounded sections on either end are the tops of the palm portion of the fingers which attach to the corresponding portions of the backs of the fingers. The cut regions which are then spread by the addition of the material increases the perimeter of the gunn sections, thereby having the effect of increasing the perimeter of the palm side of the fingers without increasing the basic dimensions of the palm side of the finger so that the longer back sections cause the fingers to curl inwardly toward the palm as desired. The angled cuts are preferably made in the area of the two joints of each of the four fingers. The material used to stretch the cut portion of the section gunn section is preferably pliable but sufficiently sturdy to maintain the perimeter of the gunn section in its stretched position. It may be natural or synthetic materials whether woven or non-woven. In one preferred embodiment of the invention the stabilizing piece also includes a central longitudinal section which stabilizes the length of the palm portion of the glove, preventing it from stretching out and, thus, losing the benefit of the pre-curvature. Such a longitudinal section is not required as the material may merely be in the areas of the spread cuts.

Figure 5:
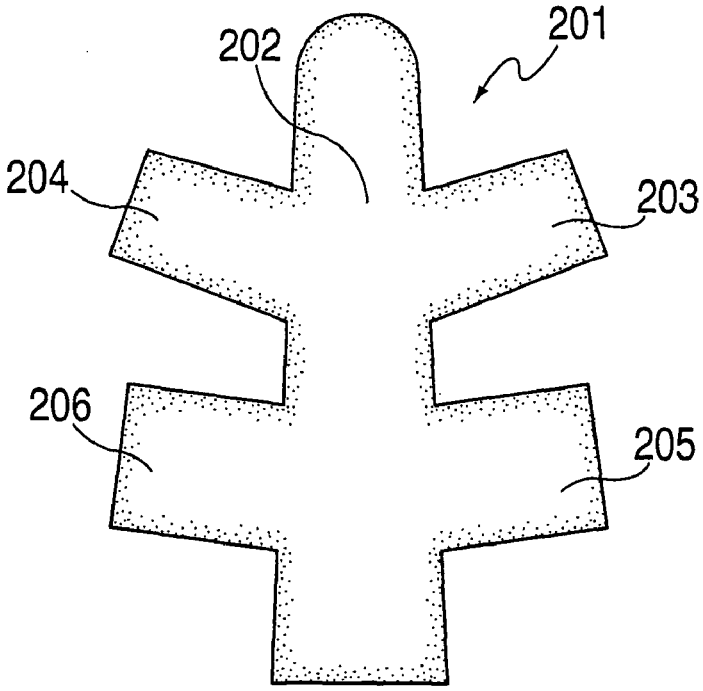
FIG. 5 is a top plan view of the spreading and longitudinally stabilizing piece for use in connection with the pre-curved gunn cut gloves constructed in accordance with a preferred embodiment of the invention.
Figure 6:
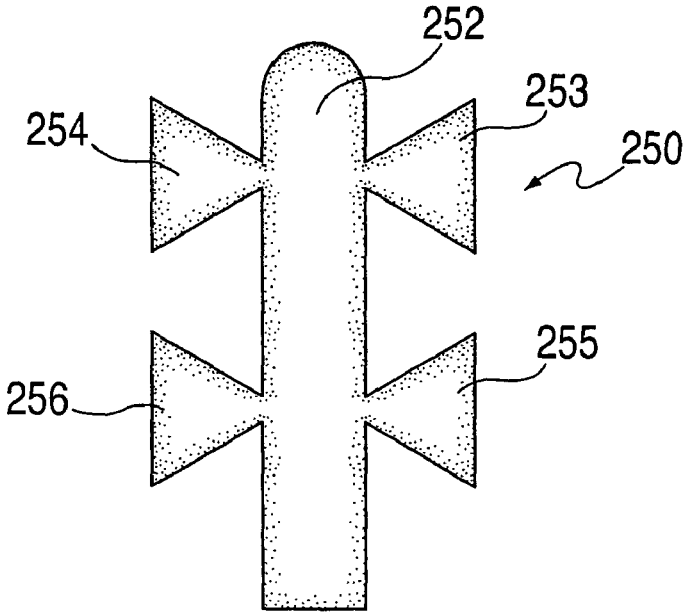
FIG. 6 is an alternate embodiment of the piece shown in FIG. 5 in accordance with another preferred embodiment of the invention.
Figure 7:
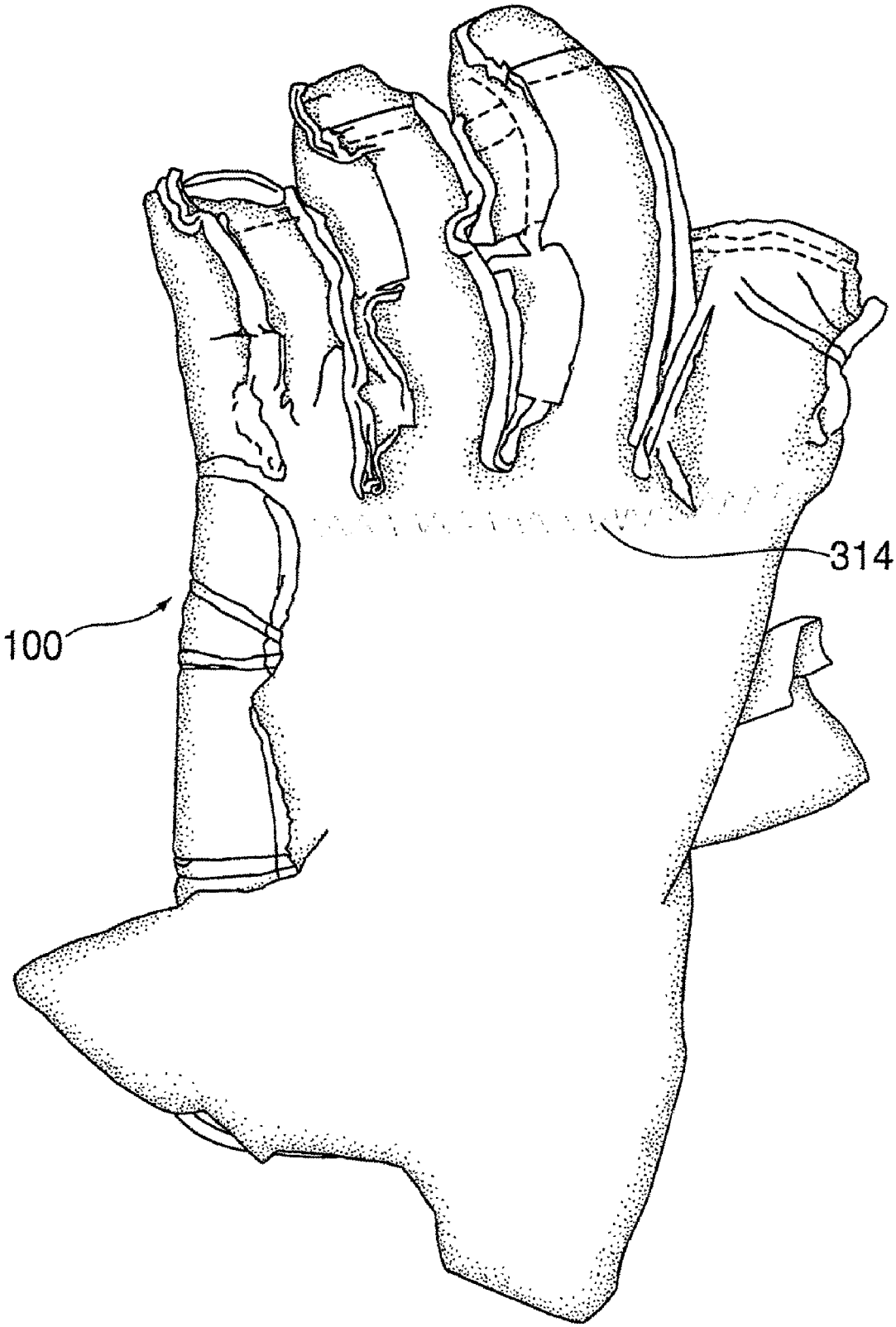
FIG. 7 is a perspective view of the inside back of the glove of FIG. 1.

Reference is made to FIGS. 5 and 6, in which two embodiments of this stretching piece are shown. In the embodiment of FIG. 5, stretching piece 201 includes a central longitudinal section 202, which traces the general shape of the palm portion of the finger with the wing portions 203, 204, 205 and 206 corresponding to the cutout triangular regions in gunn cut section 400, which are sewn to the supporting piece 201 to maintain the triangular regions in an open position. In the embodiment of FIG. 5, wing portions 203, 204, 205 and 206 are generally rectangular in shape. In practice, the end of these wing sections are often trimmed into a curved portion so they do not extend to any significant extent beyond the curved edge of the seam between the gunn cut section and finger backs. In the embodiment of FIG. 6, stretching piece 250 has a central longitudinal section 252 and generally triangular wing sections 253, 254, 255 and 256 to reduce excess material.

In a preferred embodiment of the invention the back of the fingers is longer than the front portion and the differential in the length of the back and front at their perimeters is made up for by the cut and spread triangular sections on the perimeter of the gunn cut sections. By this approach the sewer's job of joining the gunn cut section forming the palm portion of the fingers and the back portions of the fingers is simplified and the need to gather or moccasin this seam is avoided. Similarly, there is no need for the sewer to stretch or otherwise modify the perimeter of the pieces which are joined to form the finger.

In the traditional glove construction used for dress gloves and also in ski gloves, the fingers are made rather differently. The front and back portions of the fingers, which are generally connected to the palm and back of the glove respectively, are sewn to fourchettes or side panels which fit between the front and back of the finger portions from the crotch generally to the fingertip regions. To make a pre-curved glove with this construction merely requires that the fourchette be curved with the curvature adjusted so that the distance along the inside of the curved fourchette differs in length from the outside of the curved fourchette to the extent that the front and back panels of the glove differ in length. Generally, the more curvature that is intended to be used in the glove, the greater the curvature of the fourchette. However, this approach to pre-curvature is not suitable to the gunn cut construction, which is often substantially less expensive than the traditional fourchette approach.

Figure 1:
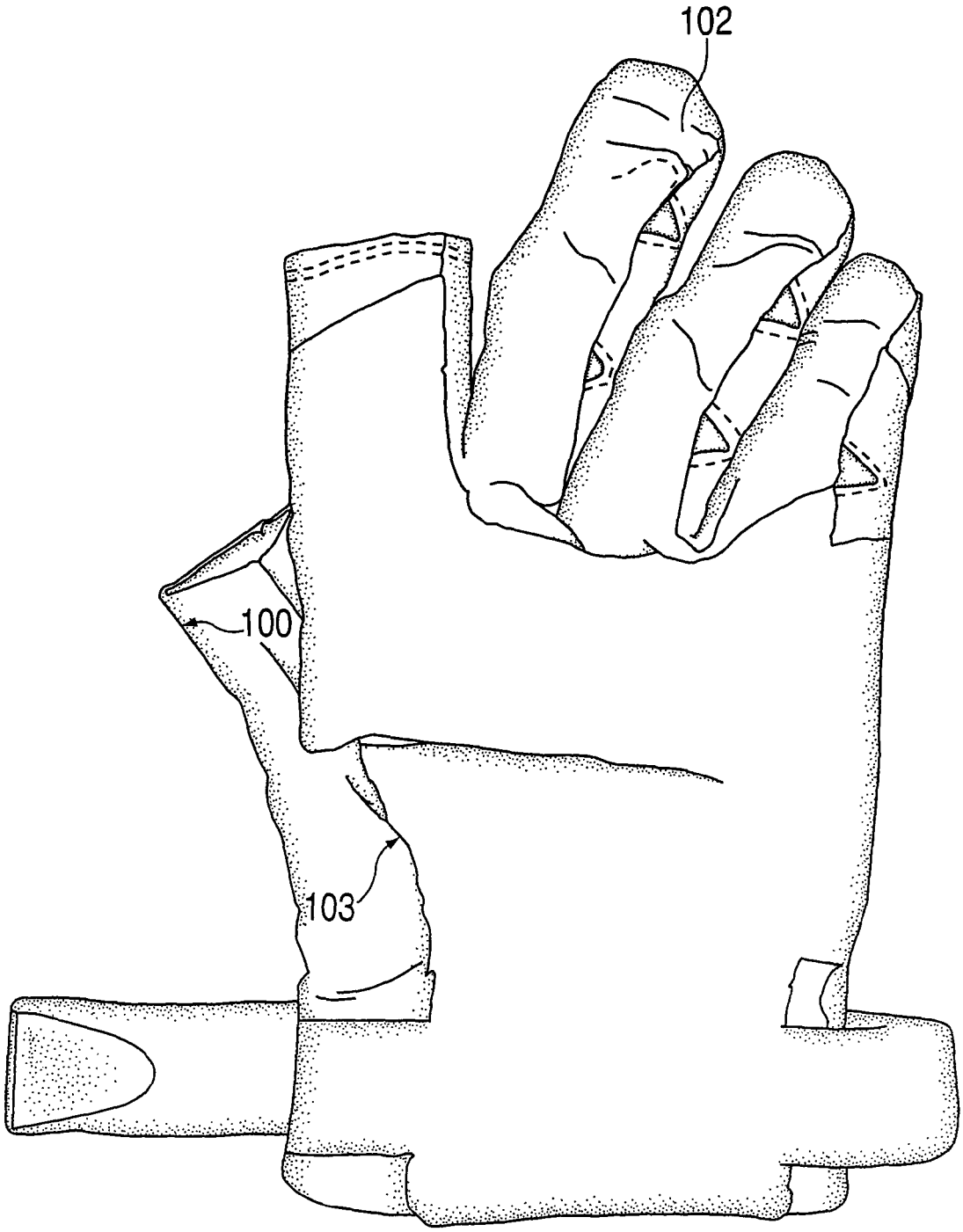
FIG. 1 is a perspective view of the back of a pre-curved gunn cut glove constructed in accordance with a preferred embodiment of the invention.
Figure 2:
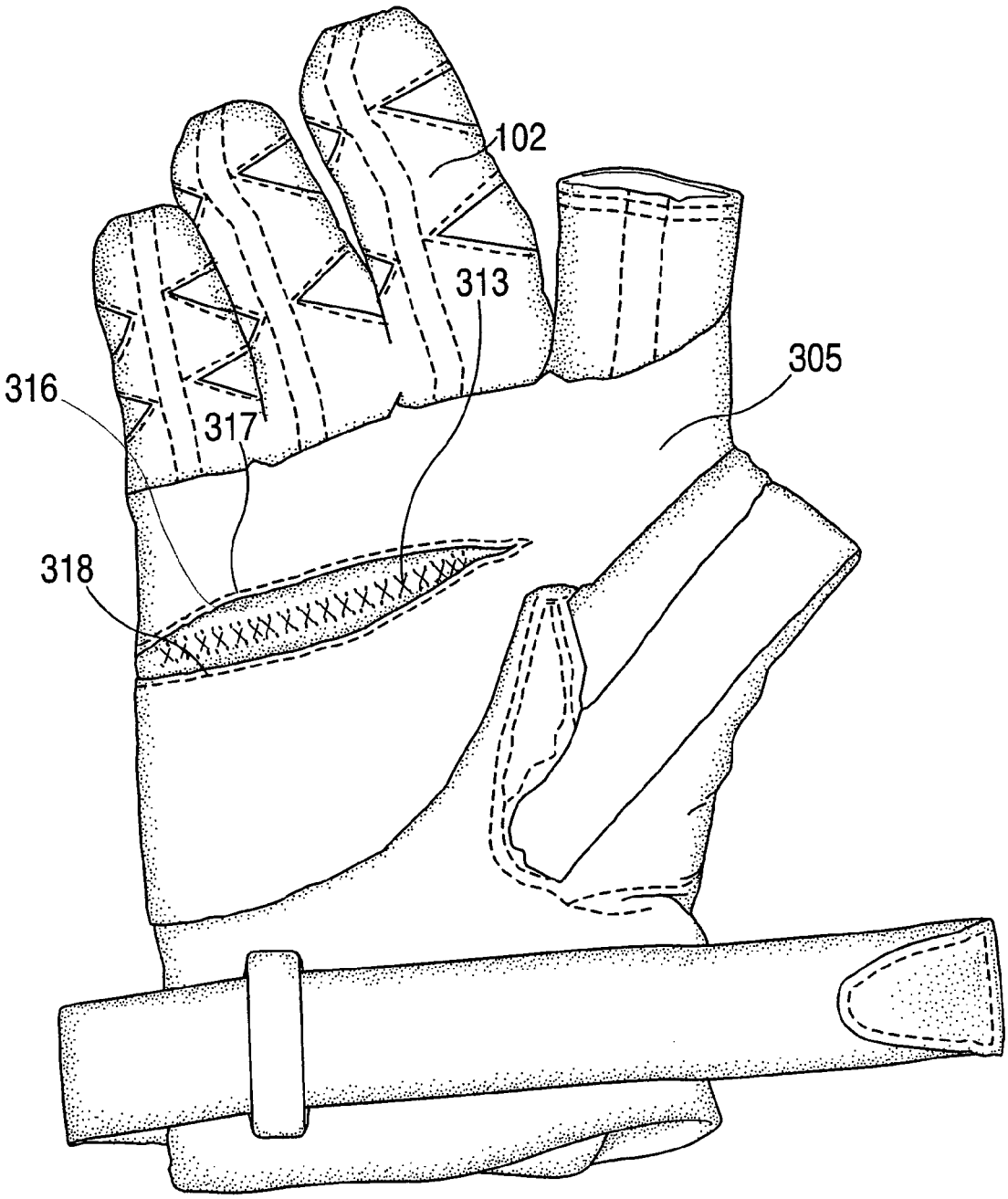
FIG. 2 is a perspective view of the palm side of the glove of FIG. 1.
Figure 3:
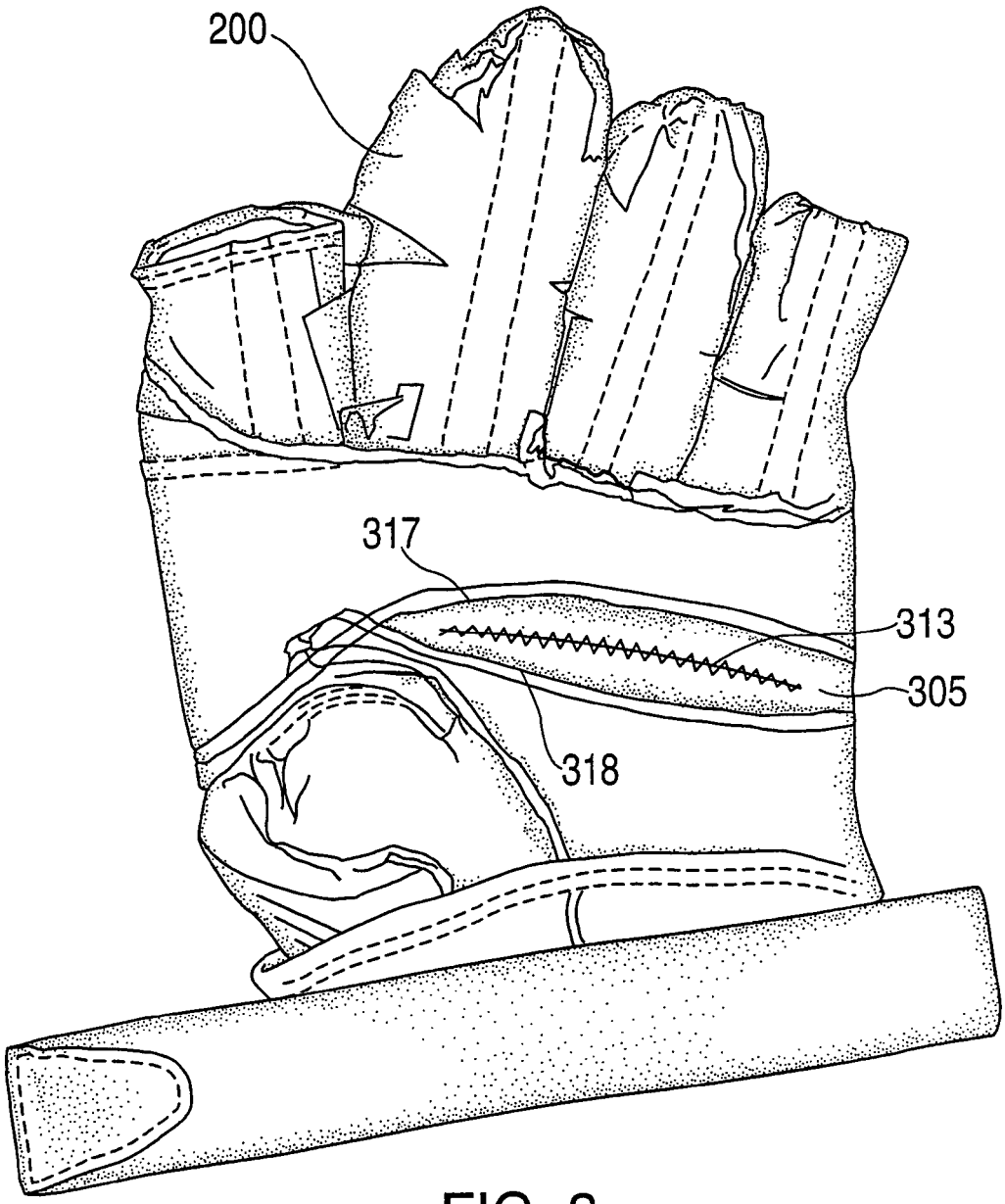
FIG. 3 is a perspective view of the inside of the palm of the glove of FIG. 1.

FIGS. 1 and 2 are perspective views of the back and palm sections of a pre-curved gunn cut construction glove constructed in accordance with a preferred embodiment of the invention and FIG. 3 is a perspective view of the inside of the palm of the same glove 100 showing the manner in which the stretching piece 200 is sewn onto the palm portion of each of the fingers 102 and stitching 313 along the elliptical cut, described below in the palm portion, and the way in which the windowed covering guard 305 with window 316 is configured with stitching 317 and 318 to enhance the inward curling through the palm region.

Figure 9:
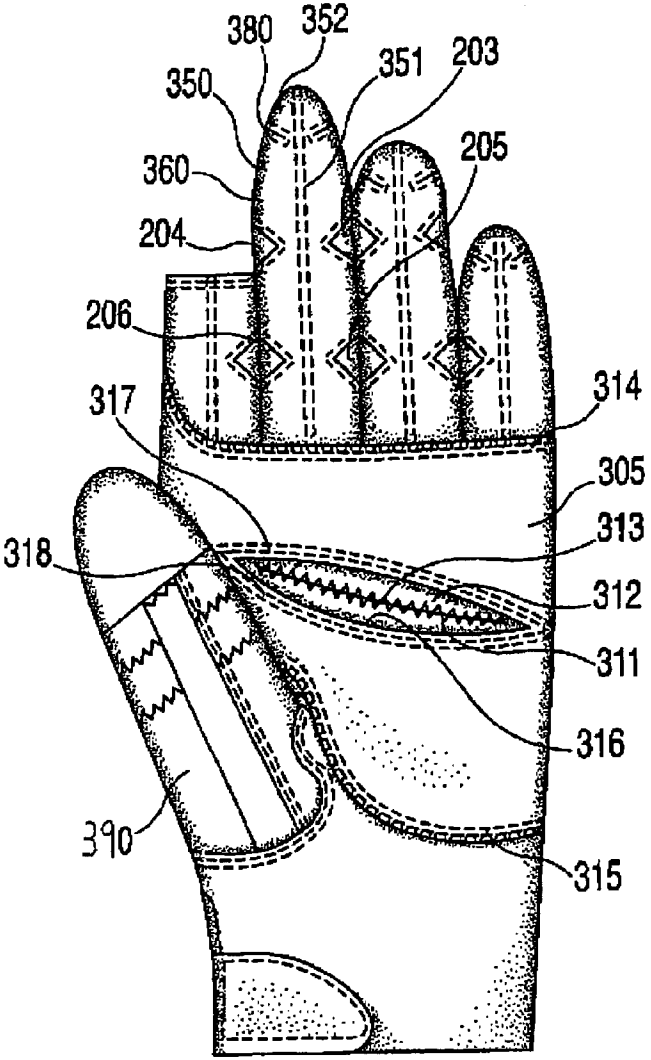
FIG. 9 is a top plan view of the palm portion of the pre-curved gunn cut glove of FIG. 8.
Figure 8:
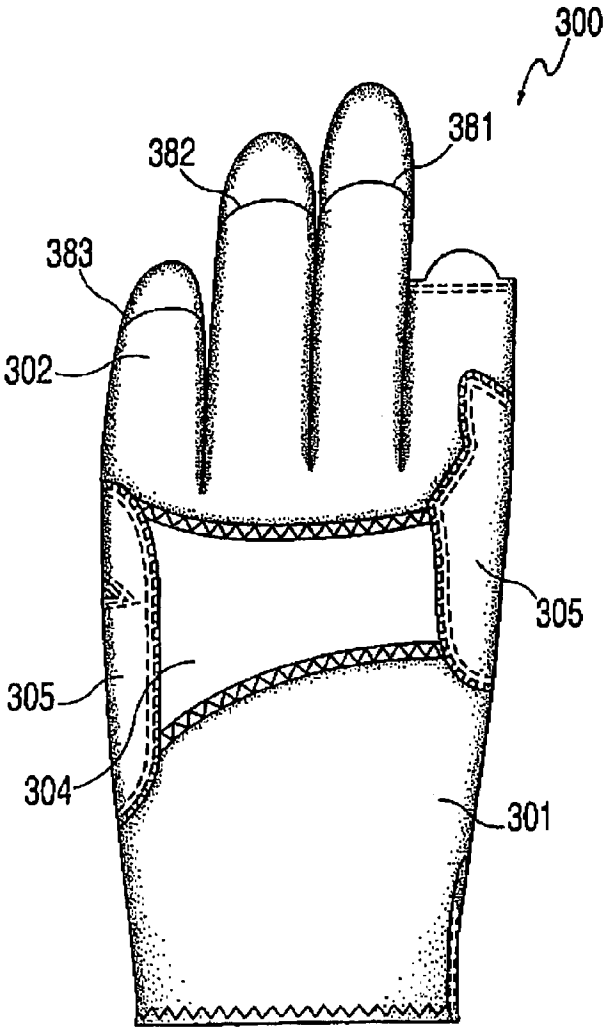
FIG. 8 is a top plan view of the back of a pre-curved gunn cut glove constructed in accordance with another preferred embodiment of the invention.

Reference is next made to FIGS. 8 and 9 which are plan views of the back (FIG. 8) and palm sides (FIG. 9) of glove 300, like elements representing like reference numerals. Glove 300 includes hand portion 301 and finger portions 302, hand back cover section 304 and palm guard section 305, which wraps around to both sides of the back of the glove 300. Guard section 305 has an opening 316 at the portion of the glove where zigzag stitching 313 is located.

Zigzag stitching 313 joins sides 311 and 312 of an elliptical shaped opening cut in the palm portion of glove 300. This elliptical opening is intended to remove additional material in the palm portion of the gunn cut glove palm upper section to enhance the flexibility of the palm portion as the hand and fingers are curled inward. The elliptical opening is held together by stitching 313, which is preferably zigzag stitching, so that the elliptical portion becomes essentially a straight line of stitching along seam 313. This has the effect of reducing the excess material on the palm side of the glove inherent to gunn cut construction. However, rather than merely covering this zigzag stitch seam 313 with a patch or covering, in accordance with the invention, an opening or window 316 in cover 305 is established. The window is essentially a section cut out of cover 305 in the desired location. The cover is stitched with stitches 317, 318 to the palm portion of the glove in an area around seam 313. This windowed section 316 has the effect of enhancing the ability of the glove to bend at the portion within the window, which is placed at the appropriate spot where a wearer's hand actually bends. Otherwise, the stitching and the covering would have the effect of inhibiting the bending feature. Cover 305 is stitched around its upper and lower perimeters with seams 314 and 315.

Reference is made to the finger region 302 of glove 300 in FIG. 9. As shown representatively on one of the fingers, the stitching 351 is used to secure the stretching piece 200 to the finger 350 along longitudinal portion 202 of stretching piece 201. In addition, the wings 203, 204, 205 and 206 of stretching piece 201 are shown in the triangular cutout regions in FIG. 9. Stitching 380 near the top enhances the volume of fingertip portion 352 as described below. It is noted that seam 314 which holds the guard 305 in place also acts to secure the fingers 302 to the lower portion 301 of gunn cut glove 300.

While the concept of expanding the perimeter of the gunn section by adding triangular shapes in the sides of the finger stalls are juxtaposed to the finger joints to allow flexion and break at the optimum points, at the ends of the fingers the gunn section is darted or cut and sewn (which is a process where a generally triangular region is cut out and the sides of the triangular region sewn to each other) to reduce the perimeter of the gunn section at that point, forcing the shape out and creating more volume there. This is shown at 380 in FIG. 9 where a triangular section of the gunn cut section is darted near the fingertip such that a triangular section of the gunn cut section is gathered along seam 380 to reduce the perimeter at that point. The darting can be accomplished by either gathering the material and sewing it along the gathered seam or by physically cutting out a triangular portion of the gunn cut section and then sewing the adjacent surfaces together.

It is also particularly advantageous where the fingertips on the palm side extend as shown in FIGS. 8 and 9, some distance beyond the finger ends (usually one to two centimeters, though greater or lesser distances are possible) so that the seam between the material forming the palm portion and the back portion of the fingers is not at the end of the fingertips. This has two advantages. It keeps wear away from the fingertip seam and it keeps the adjoining seam away from the fingertips, which is particularly important in applications that require fingertip sensitivity such as sailing gloves and other types of gloves. This wrap concept, where the finger on the palm side is wrapped around the fingertip and down the back side a distance (preferably 1–2 cm, although greater or lesser distances are possible), is shown particularly in FIG. 8 where seams 381, 382 and 383 join the front and back portions of the fingers a distance below the fingertips on the back side of the fingers. Apart from the other features shown in connection with the gunn cut construction, this manner of finger construction on a gunn cut glove may be used regardless of whether the glove construction is pre-curved or not. This type of construction provides the dual benefits of avoiding wear at the fingertip seam, which can reduce the useful life of the glove, and keeping the joining seam away from the fingertip region, where fine touch and sensitivity is required. If the fingertip seam is right at the tip of the finger, this reduces the sensitivity of the wearer's fingers through the glove at the fingertips.

In a similar fashion, the thumb 390 may be pre-curved in the same fashion that the fingers 302 are pre-curved. The same approach may also be utilized in connection with a gunn cut construction mitten to achieve pre-curvature and also the wrap around feature.

Thus, several novel features are highlighted in connection with the gunn cut construction disclosed herein. A pre-curvature to the gloves is accommodated through the use of the cuts and stretcher pieces, which enhance the perimeter of the palm portion of the fingers without substantially lengthening the center of the palm portion of the fingers to provide a pre-curved shape to the glove fingers in a gunn cut construction. In addition, the reduction of the additional material on the palm side of the glove in the palm portion is achieved by cutting an elliptical shaped section out of the palm portion and stitching this together. This reduction in material enhances the ability of the glove to fit the palm better and to flex inwardly without excess material interfering with the movement. This enhanced movement is further improved by the use of a patch or guard member 305 having a windowed section removed surrounding the stitching joining the sides of the elliptical cutout region. This provides differentially improved bending of the glove in the palm region and, in particular, at the windowed cutout region of the guard. The guard region is centered preferably along the natural line along which the hand naturally folds. Also, in addition to the expansion of the perimeter of the gunn section by adding triangular shapes in the sides of the finger stalls which are juxtaposed to the finger points to allow flexion and break at the optimum points, the opposite concept of darting the gunn section at the fingertips to reduce the perimeter of the gunn section at that point, forcing the shape out and creating more volume at the finger tips is achieved. Finally, the palm finger stalls are extended beyond the ordinary termination of the finger length and wrapped to the back of the finger stalls and joined to the back portion of the finger stalls some distance from the finger ends to reduce wear on the fingertip seam and provide enhanced sensitivity at the fingertip regions in a gunn cut glove construction. The features shown herein may also be applied to pre-curvature of the thumb portion in a gunn cut glove construction and a mitten fingers section in accordance with a gunn cut construction.

Generally, the gloves manufactured in accordance with a preferred embodiment of the invention can be formed of traditional natural or synthetic leathers or other manmade or natural materials. Leathers are particularly suitable as the cut and spread sections can be created without affecting the way in which the remaining portion of the leather falls. The gunn cut construction can either be an arrangement in which the gunn cut section is used for the middle and ring finger with a single gunn cut section or can have two gunn cut sections: one for the index and middle finger, and the other for the ring and pinkie fingers.

The glove can be used for skiing or snowboarding, sailing, golf or other industrial or sporting uses. The gunn cut construction has a wraparound feature, so that the palm section of the fingers has no seam on the palm side but only on the edge of the finger. This is particularly useful for sailing and golf gloves. Similarly, the use of the stabilizing piece to support the additional material added in the cut and spread sections provides length stability for the palm side of the fingers, which is critical in a golf glove application.

Accordingly, an improved pre-curved gunn cut glove construction which provides effective pre-curvature of the fingers toward the palm section without the need to gather or moccasin the edges of the fingers is provided.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. A gunn cut glove construction, comprising:

a back portion of the glove;

a palm portion of the glove;

a fingers back portion having a first length; and a gunn cut section including palm finger sections of at least two fingers wherein a perimeter of a fingers back portion gunn cut section is enlarged by a cut section spread with a stabilizing material secured to the fingers back portion creating a generally triangular section, and making the palm portion of the fingers curl inward; and the back portion of the glove, palm portion of the glove, back portion of the fingers and gunn cut section are secured to each other to form a glove, wherein the gunn cut glove construction does not include any fourchettes.

2. The gunn cut glove of claim 1 further including a seam, connecting respective interior edges of the palm portion formed by the removal of a section of the palm portion.

3. The gunn cut glove of claim 2 wherein the palm portion of the glove has a guard secured to the palm portion.

4. The gunn cut glove of claim 3 wherein the guard has a cutout window section which is located over the seam in the palm, providing a section around the seam where there is no guard, thereby enabling enhanced flexibility in the window section.

5. The gunn cut glove of claim 4 wherein the guard's window section is placed proximate an area where a wearer's hand bends as the fingers are curled inward to make a fist.

6. The gunn cut glove of claim 2 wherein the section removed from the palm section is generally elliptical in shape.

7. The gunn cut glove of claim 6 wherein the seam joining the sides of the section removed from the palm section is generally linear.

8. The gunn cut glove construction of claim 1 wherein the gunn cut finger section proximate the fingertips is darted to increase the volume at the fingertips.

9. The gunn cut glove construction of claim 1 wherein the gunn cut finger section proximate the fingertips is cut and sewn to increase the volume at the fingertips.

10. The gunn cut glove construction of claim 1 wherein the palm gunn cut finger sections have an extended length such that respective ends of said palm gunn cut finger sections are secured to the fingers back portions at a distance from said fingertips on the back surface of the glove.

11. The gunn cut glove construction of claim 10 wherein the gunn cut finger sections extend a distance between about one and two centimeters beyond the fingertips.

12. A gunn cut glove construction, comprising:

a back portion of the glove;

a palm portion of the glove;

a fingers back portion having a first length; and a gunn cut section including palm finger sections of at least two fingers wherein a perimeter of the fingers back portion gunn cut section is enlarged by a cut section spread with a stabilizing material creating a generally triangular section in each of the areas corresponding to the finger joints, and making the palm portion of the fingers curl inward, and the perimeter is darted or cut and sewn to reduce the perimeter around the fingertips to increase the volume of the fingers of the glove around the fingertips; and the back portion of the glove, palm portion of the glove, back portion of the fingers and gunn cut section are secured to each other to form a glove, wherein the gunn cut glove construction does not include any fourchettes.

13. The gunn cut glove of claim 12 further including a seam, connecting respective interior edges of the palm portion formed by the removal of section of the palm portion.

14. The gunn cut glove of claim 13 wherein the palm portion of the glove has a guard secured to the palm portion.

15. The gunn cut glove of claim 14 wherein the guard has a cutout window section which is located over the seam in the palm, providing a section around the seam where there is no guard, thereby enabling enhanced flexibility in the window section.

16. The gunn cut glove of claim 15 wherein the guard's window section is placed proximate an area where a wearer's hand bends as the fingers are curled inward to make a fist.

17. The gunn cut glove of claim 13 wherein the section removed from the palm section is generally elliptical in shape.

* * * * *